US005779084A

United States Patent [19]

Lehman

[11] Patent Number: 5,779,084

[45] Date of Patent: Jul. 14, 1998

[54] LAUNDRY RECEPTACLE WITH FLEXIBLE COVER

[75] Inventor: Peter G. Lehman, Evanston, Ill.

[73] Assignee: SP Watersports, Inc., Evanston, Ill.

[21] Appl. No.: 795,634

[22] Filed: Feb. 6, 1997

[51] Int. Cl.[6] ..... B65D 43/20

[52] U.S. Cl. ..... 220/346; 220/350; 220/772; 206/508

[58] Field of Search ..... 220/252, 262–264, 220/287, 316, 324, 326, 335, 345, 346, 348, 350, 351, 908, 1.5; 160/23.1, 24, 370.22; 296/98; 206/508

[56] References Cited

U.S. PATENT DOCUMENTS

| | | | |
|---|---|---|---|
| 1,142,865 | 6/1915 | Westfield | 160/24 |
| 3,173,568 | 3/1965 | Magnuson | 220/372 |
| 3,299,932 | 1/1967 | Stolfo | 160/23.1 X |
| 3,591,034 | 7/1971 | Lohr et al. | 220/350 X |
| 3,687,328 | 8/1972 | Spruyt et al. | 220/908 X |
| 4,916,764 | 4/1990 | Meaden et al. | 160/23.1 X |
| 4,919,264 | 4/1990 | Shinall | 220/346 X |
| 5,271,634 | 12/1993 | Walton | 160/23.1 X |
| 5,354,113 | 10/1994 | Pettersson | 296/98 |
| 5,443,923 | 8/1995 | Laniado et al. | 296/98 X |
| 5,655,807 | 8/1997 | Rosario | 296/98 |
| 5,671,790 | 9/1997 | Anderson et al. | 160/24 |

*Primary Examiner*—Allan N. Shoap
*Assistant Examiner*—Nathan Newhouse
*Attorney, Agent, or Firm*—Arent Fox Kintner Plotkin & Kahn

[57] ABSTRACT

A laundry receptacle with a flexible cover and handles comprises a structurally rigid receptacle portion and a flexible covering assembly. The rigid receptacle portion may be of a variety of sizes and shapes. The flexible covering assembly is comprised of a flexible covering material of varying sizes and shapes, which is wound around a cylindrical rod when not in use, and which is unrolled and extended across the open upper end of the rigid laundry receptacle and affixed to a circumferential flange that is itself integrally secured to the open upper end. The cylindrical rod is cooperatively attached to hinges at its opposite ends. The hinges are, in turn, securely affixed to the circumferential flange, so as to allow the cylindrical rod to rotate and the flexible cover to unroll over the open upper end of the rigid laundry receptacle. The flexible covering material may also be secured to the outer circumference of open upper end of the rigid receptacle by a continuous elastomeric band which is circumferentially securely positioned around the flexible material about its outer edge.

14 Claims, 2 Drawing Sheets

LAUNDRY RECEPTACLE WITH FLEXIBLE COVER

BACKGROUND OF THE INVENTION

The present invention relates to a laundry receptacle with a flexible covering assembly, which finds particular utility by providing a means to retain, cover and protect an amount of clothing or other launderable material which is larger than the internal volumetric area of the receptacle itself. In the field of laundry receptacles, there exists a need for a laundry basket or hamper, which includes a flexible covering of varying length that is capable of expanding and conforming to the shape of clothing and other launderable materials in the event that the laundry receptacle becomes overloaded.

In a household, college dormitory or commercial setting, there may be significant intervals between launderings. Therefore, clothing, bedding and other launderable materials may accumulate in a laundry receptacle, until their volume exceeds the internal area of the receptacle. This presents the problem of instances where the launderable materials inside the receptacle may fall out of the receptacle, either when the receptacle is at rest, or when it is being transported to the laundry room, etc. In addition, launderable materials which are piled above the upper edge of the receptacle create an unsightly visual appearance and in some cases an unpleasant odor. Exposed launderable materials in this way may also make them vulnerable to ambient dust, dirt and odors.

There currently exist a number of conventional methods for retaining launderable materials within a laundry receptacle, masking their appearance and protecting them. For example, many laundry baskets or hampers utilize a rigid plastic receptacle along with a cover which is made out of the same rigid material. This cover is generally molded to fit the size and contour of the open upper end of the laundry receptacle. The cover may lie flat on top of the open upper end, thus failing to augment the holding capacity and flexibility of the laundry receptacle. The cover may also be convex in shape, such that it increases the holding capacity of the laundry receptacle by a fixed amount. However, these methods of retaining and shielding launderable materials are disadvantageous, since the amount of launderable materials that may be retained is fixed and if this fixed amount is exceeded, the laundry receptacle may fail to accomplish its purpose of retaining, masking and protecting the materials contained therein.

SUMMARY OF THE INVENTION

It is therefore an object of the present invention to provide an inexpensive, easy to use, practical apparatus which provides flexibility in the amount and types of launderable materials that can be retained, masked and shielded in a rigid laundry receptacle, either when the receptacle is at rest, or when it is being transported.

It is a further object of the invention to provide a cover made of flexible material which may vary in length and shape and which can be incrementally extended over the open upper end of a rigid laundry receptacle in order to accommodate varying amounts and types of launderable materials, which may, in turn, rise above the open upper end of the receptacle.

It is still a further object of the present invention to provide a flexible cover which is able to conform securely to the contours of the open upper end of the laundry receptacle and to the launderable materials that it is to retain, mask and protect.

Additional objects and advantages of the invention will be set forth in part in the description which follows, and in part will be obvious from the description, or may be learned by practice of the invention.

To achieve these and other objects, and in accordance with the purposes of the invention, as embodied and broadly described herein, a laundry receptacle with a flexible cover and a pair of handles is provided comprising a structurally rigid receptacle portion with an open upper end and a flexible covering assembly. The rigid receptacle portion may be of a variety of sizes and shapes. The structurally rigid receptacle portion has a circumferential flange integrally secured to its open upper end. The flexible covering assembly includes a flexible covering material, which may vary as to size and shape; a cylindrical rod around which the flexible covering material is wrapped when not in use, and which can be unrolled and extended across the open upper end of the rigid laundry receptacle and be affixed to a circumferential flange that is itself integrally secured to the open upper end. The cylindrical rod is cooperatively attached to hinges at its opposite ends. The hinges are, in turn, securely affixed to the circumferential flange, so as to allow the cylindrical rod to rotate and the flexible cover to unroll over the open upper end of the rigid laundry receptacle.

The flexible cover may also be of a size and shape which is substantially similar to that of the open upper end of the receptacle portion. The cylindrical rod to which the flexible cover material is attached may have spring-loaded hinges which cause the rod to automatically turn and wrap the flexible cover material therearound when the cover is detached from the circumferential flange. In another embodiment, there are means provided for manually rolling the flexible cover material around the cylindrical rod when it retracted after detachment from the circumferential flange. The flexible cover material is also securely attached at one end to the cylindrical rod. The free end of the flexible cover material may be attached to the circumferential flange by the use of hooks, a locking mechanism or a hook and loop means such as Velcro™.

The flexible cover material may also be secured to the open upper end of the rigid laundry by a continuous elastomeric band which is circumferentially securely positioned around the flexible material, so that it conforms to the outer circumference of the open upper end. Finally, for the convenience of the user, a rigid shelf may be attached to the flexible covering material in order to hold smaller launderable items.

The accompanying drawings, which are incorporated in and constitute a part of the specification, illustrate one preferred embodiment of the invention and, together with the general description of the invention given above and the detailed description of the preferred embodiment given below, serve to explain the principles of the invention.

DETAILED DESCRIPTION OF THE PREFERRED EMBODIMENTS

Figure 1:
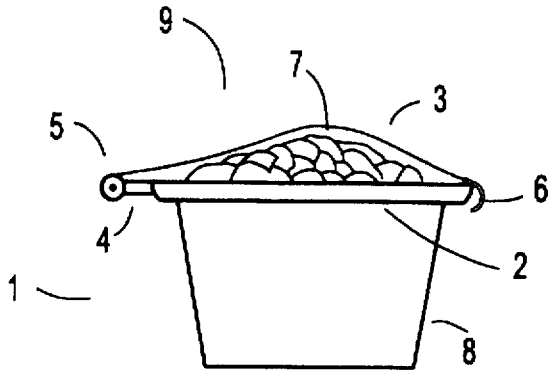
FIG. 1 illustrates a side elevational view of a laundry basket with a flexible cover which is fully extended and attached to the circumferential flange of the rigid receptacle in accordance with an embodiment of the present invention.

Reference will now be made in detail to the present preferred embodiments of the invention, examples of which are illustrated in the accompanying drawings in which like reference characters refer to corresponding elements.

Figure 2:
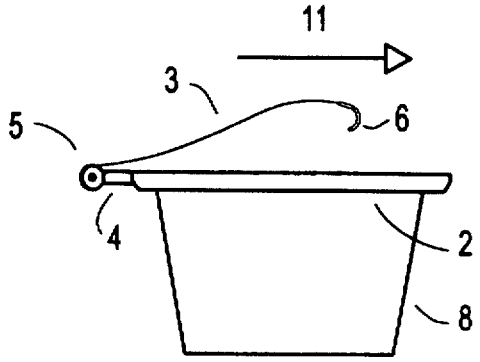
FIG. 2 illustrates a side elevational view of the laundry basket with a flexible cover which is partially extended.
Figure 4:
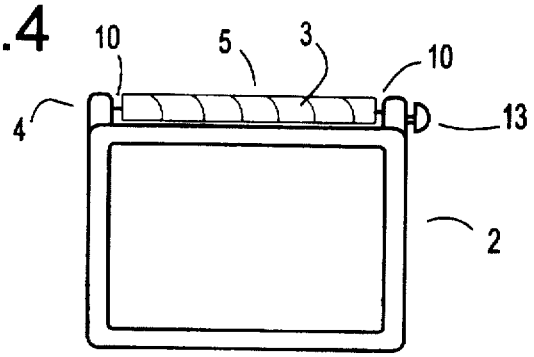
FIG. 4 illustrates a plan view of the open upper end of the rigid receptacle and the flexible cover assembly where the flexible cover is retracted around the cylindrical rod.

Referring to FIGS. 1, 2, and 4, the laundry receptacle with a flexible covering of the present invention, generally denoted 1 and 3 is shown. Laundry receptacle 1 includes a structurally rigid receptacle portion 8, a pair of handles 10 and a flexible cover assembly 9. The rigid receptacle portion 8 may be of a variety of shapes and sizes and may be constructed of a variety of materials, such as, for example, plastic. It includes a circumferential flange 2 integrally attached to its open upper end which, among other things, acts as a base for the attachment of the flexible covering assembly 9. Flexible covering assembly 9 may also be of a variety of shapes and sizes and may be constructed of a variety of materials and fabrics. Flexible covering assembly 9 comprises a flexible covering material 3, such as, for example, a nylon mesh fabric, which is attached at one end to a cylindrical rod 5 by glue or other adhesive material and at the other (free) end to an attachment means 6, which may be a hook, clip or locking mechanism that cooperatively attaches to the circumferential flange 2 (as described below). A pair of hinges 4 are cooperatively and rotatably attached to posts 11, which protrude from opposite ends of the cylindrical rod 5. The pair of hinges 4 are in turn fixedly secured to the circumferential flange 2 of the rigid receptacle portion 8, so that the circumferential flange does not interfere with the rotation of the cylindrical rod 5. In this way, the flexible cover material 3 is allowed to extend and retract over the open upper end of the rigid receptacle 8.

Figure 3:
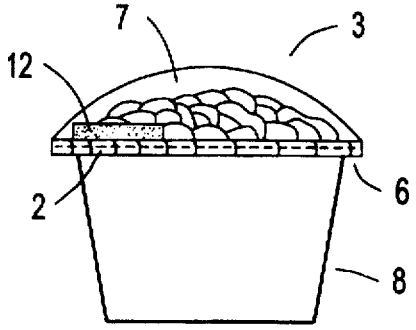
FIG. 3 illustrates a front elevational view of the laundry basket with a rigid receptacle portion and a flexible covering assembly which is attached to a circumferential flange at the open upper end of the rigid receptacle.
Figure 5:
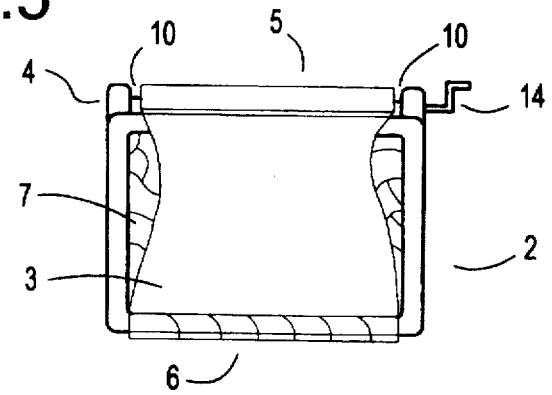
FIG. 5 illustrates a plan view of the open upper end of the rigid receptacle and the flexible cover assembly where the flexible cover is fully extended and attached to the circumferential flange.
Figure 6:
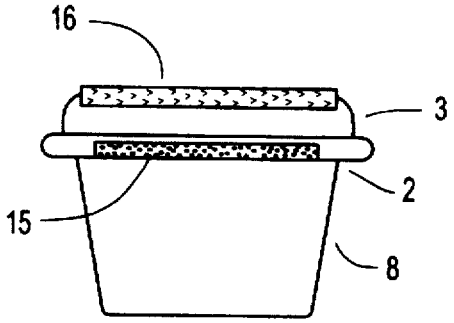
FIG. 6 illustrates a front elevational view of a laundry basket with a rigid receptacle portion and a flexible covering assembly secured to the receptacle by a hook and loop arrangement.

As shown in FIG. 4, the flexible covering material 3 may be wrapped around the cylindrical rod 5 when not in use. When the user desires to extend the flexible covering material 3 over the open upper end of the rigid receptacle 8, he may grasp the attachment means 6 and unwrap the flexible covering material 3 from cylindrical rod 5 by applying radial force 25, as shown in FIG. 2. Referring now to FIGS. 1, 3, and 5, the flexible covering material 3 may be fully extended over the open upper end of the rigid receptacle 8 and cooperatively attached to the circumferential flange 2 by attachment means 6. Attachment means 6 may take the form of a hook, clip or locking mechanism which substantially conforms to the size and contour of the circumferential flange 2. Additionally, as illustrated in FIG. 6, the attachment means 6 may include a pair of cooperative hook and loop strips, made of a material such as Velcro™. For example, a hook strip 15 may be affixed to the outside of the circumferential flange 2, while a cooperative loop strip 16 may be affixed to the underside of the free end of the flexible covering material 3. The flexible covering material 3 is securely retained on the circumferential flange 2 by the mating of the hook strip 15 and the loop strip 16.

As shown in FIGS. 1 and 3, the flexible covering material 3 is generally larger than the opening at the upper end of the rigid receptacle 8, so that it is able to conform to and accommodate the convex shape of the launderable material 7 retained in an overloaded rigid receptacle 8. It can also be of substantially the same size and shape as the opening at the upper end of the rigid receptacle 8.

In another embodiment of the invention, the flexible covering material may also include a small rigid shelf 12, upon which small articles of clothing or other launderable materials may be placed in order to dry, etc. The flexible covering assembly 9 may include a pair of hinges 4 which are spring loaded, so that the cylindrical rod 5 has the ability to automatically rotate and wrap the flexible covering material 3 around it when attachment means 6 is detached from the circumferential flange 2. In this way, the flexible covering material 3 may be stored between uses.

In another embodiment of the invention, the pair of hinges 4 may include means as shown in FIGS. 4 and 5 for manually retracting the flexible covering material 3 around the cylindrical rod 5 when attachment means 6 is detached from the circumferential flange 2. These manual retraction means may take the form of a knob 13 or a crank handle 14, which are rotatably attached to hinge 4 and to the cylindrical rod 5. When manually turned, knob 13 and crank handle 14 cause the cylindrical rod 5 to rotate, thus wrapping the flexible covering material 3 therearound for storage.

Figure 7:
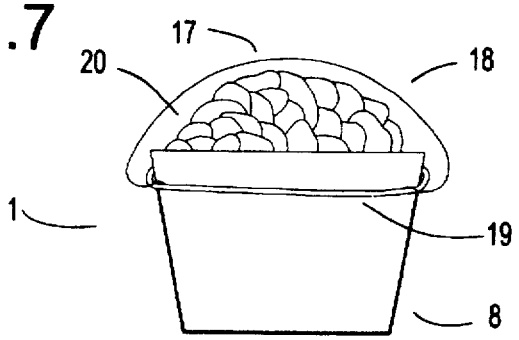
FIG. 7 illustrates a front elevational view of the laundry basket with a rigid receptacle portion and a flexible covering assembly secured to the receptacle portion by a continuous elastomeric band.

An alternative embodiment of the present invention, as shown in FIG. 7, comprises a laundry receptacle 1 with a flexible cover, which includes a structurally rigid receptacle portion 8 with an open upper end and a flexible covering assembly 18. The flexible covering assembly 18 consists of a flexible covering material 17 and a continuous elastomeric band 19, which is securely positioned around the outer circumference of the flexible covering material 17 in a manner similar to a rubber band. The continuous elastomeric band 19 secures the flexible covering to the outer circumference of the open upper end of the rigid receptacle portion 8. The continuous elastomeric band 19 may be fixedly attached to the laundry receptacle 1 or it may be a piece separate from the laundry receptacle 1. The flexible covering material 3 is generally larger than the opening of the upper end of the rigid receptacle 8, so that it may expand to accommodate and substantially conform to the convex shape of launderable material 20 as it is found in an overloaded laundry receptacle 1. However, the flexible covering material 3 can also be of substantially the same size and shape as the opening at the upper end of the rigid receptacle 8.

It will be apparent to those skilled in the art that various modifications and variations can be made in the apparatus of the present invention without departing from the scope or spirit of the invention. Thus, it is intended that the present invention cover the modifications and variations of this invention provided they come within the scope of the appended claims and their equivalents.

What is claimed is:

1. A laundry receptacle with a flexible cover and a pair of handles, comprising:

a structurally rigid receptacle portion with an open upper end and a flexible covering assembly, said structurally rigid receptacle portion having a circumferential flange integrally secured to its open upper end, said flexible covering assembly including a flexible covering material, a cylindrical rod around which the flexible covering material is wrapped when not in use, a pair of hinges that are cooperatively attached to opposite ends of the cylindrical rod, which hinges are in turn fixedly secured to the circumferential flange of the receptacle portion, so as to allow the cylindrical rod to rotate;

first attachment means, which secure the flexible cover to the cylindrical rod, and second attachment means, which secure the flexible cover to the circumferential flange when the flexible covering material is unwrapped from said cylindrical rod and extended over the open upper end of the rigid receptacle portion.

2. The laundry receptacle with a flexible cover and a pair of handles as claimed in claim 1, wherein said hinges are spring-loaded, so as to cause the cylindrical rod to automatically rotate and wrap the flexible cover therearound when the second attachment means is detached from the circumferential flange.

3. The laundry receptacle with a flexible cover and a pair of handles as claimed in claim 1, further comprising:

means for manually retracting the flexible cover around the cylindrical rod when the second attachment means is detached from the circumferential flange.

4. The laundry receptacle with a flexible cover and a pair of handles as claimed in claim 3, further comprising:

a crank handle rotatably engaged to one of said hinges and to said cylindrical rod, said crank handle being turned in order to manually retract the flexible cover.

5. The laundry receptacle with a flexible cover and a pair of handles as claimed in claim 3, further comprising:

a knob rotatably engaged to one of said hinges and to said cylindrical rod, said knob being turned in order to manually retract the flexible cover.

6. The laundry receptacle with a flexible cover and a pair of handles as claimed in claim 1, further comprising:

a rigid shelf securely affixed to the flexible cover.

7. The laundry receptacle with a flexible cover and a pair of handles as claimed in claim 1, wherein said second attachment means is comprised of a hooking mechanism for grasping the contour of the circumferential flange.

8. The laundry receptacle with a flexible cover and a pair of handles as claimed in claim 1, wherein said second attachment means is comprised of a locking mechanism for grasping the contour of the circumferential flange.

9. The laundry receptacle with a flexible cover and a pair of handles as claimed in claim 1, wherein said flexible cover is of substantially the same size and shape as the open upper end of the rigid receptacle portion.

10. A laundry receptacle with a flexible cover and a pair of handles, comprising:

a structurally rigid receptacle portion with an open upper end;

a circumferential flange; and a flexible covering assembly, said flexible covering assembly including a flexible covering material, a cylindrical rod around which the flexible covering material is stored, a pair of hinges that are cooperatively attached to opposite ends of the cylindrical rod, said hinges being fixedly secured to the circumferential flange of the rigid receptacle portion;

said flexible covering material having first attachment means, which secure the flexible cover to the cylindrical rod; and a first hook and loop fastener means, mounted on a free end of said flexible covering material, said first hook and loop fastener means cooperatively attaching to a second hook and loop means circumferentially mounted on the open upper end of the rigid receptacle portion.

11. The laundry receptacle with a flexible cover and a pair of handles as claimed in claim 10, wherein said flexible cover is of substantially the same size and shape as that of the open upper end of the rigid receptacle portion.

12. The laundry receptacle with a flexible cover and a pair of handles as claimed in claim 10, wherein said hinges are spring-loaded, thereby automatically retracting the flexible covering material around the cylindrical rod when the flexible covering material is detached from the circumferential flange.

13. The laundry receptacle with a flexible cover and a pair of handles as claimed in claim 10, further comprising:

means for manually retracting the flexible covering material around the cylindrical rod when said flexible cover is detached from the circumferential flange.

14. The laundry receptacle with a flexible cover and a pair of handles as claimed in claim 10, further comprising:

a rigid shelf securely affixed to the flexible covering material.

* * * * *